US011505220B1

(12) United States Patent
Taylor

(10) Patent No.: US 11,505,220 B1
(45) Date of Patent: Nov. 22, 2022

(54) AUTOMATIC HATCH COVER FOR A CONTAINER AND METHODS OF OPERATION THEREOF

(71) Applicant: Fred Joseph Taylor, Independence, KY (US)

(72) Inventor: Fred Joseph Taylor, Independence, KY (US)

( * ) Notice: Subject to any disclaimer, the term of this patent is extended or adjusted under 35 U.S.C. 154(b) by 0 days.

(21) Appl. No.: 17/868,787

(22) Filed: Jul. 20, 2022

Related U.S. Application Data

(63) Continuation of application No. PCT/US2021/015595, filed on Jan. 29, 2021.

(60) Provisional application No. 62/968,162, filed on Jan. 31, 2020.

(51) Int. Cl.

| | |
|---|---|
| ***E05F 15/53*** | (2015.01) |
| ***B61D 39/00*** | (2006.01) |
| ***B61D 7/00*** | (2006.01) |
| ***E05B 81/52*** | (2014.01) |
| ***E05B 83/02*** | (2014.01) |

(52) U.S. Cl.
CPC ..... *B61D 39/006* (2013.01); *B61D 7/00* (2013.01); *E05B 81/52* (2013.01); *E05B 83/02* (2013.01); *E05F 15/53* (2015.01); *E05Y 2201/454* (2013.01); *E05Y 2201/626* (2013.01); *E05Y 2201/686* (2013.01); *E05Y 2900/51* (2013.01)

(58) Field of Classification Search
CPC ..... B61D 39/006; B61D 7/00; E05B 81/52; E05B 83/02; E05B 83/00; E05F 15/53; E05F 15/63; E05F 15/00; E05F 15/565; E05Y 2201/454; E05Y 2201/626; E05Y 2201/686; E05Y 2900/51; E05D 11/1007; E05D 2015/1086; E06B 3/325
See application file for complete search history.

(56) References Cited

U.S. PATENT DOCUMENTS

| | | | | |
|---|---|---|---|---|
| 3,476,042 | A | 11/1969 | Carney, Jr. et al. | |
| 3,931,768 | A | 1/1976 | Price et al. | |
| 4,854,076 | A | 8/1989 | Sieben et al. | |
| 6,293,051 | B1 | 9/2001 | Matye | |
| 8,939,088 | B2 * | 1/2015 | Yue | B61D 7/02 105/286 |

(Continued)

FOREIGN PATENT DOCUMENTS

| | | | | |
|---|---|---|---|---|
| DE | 102005033609 | A1 * | 1/2007 | B60J 7/198 |
| WO | WO-2006066526 | A1 * | 6/2006 | B60J 7/185 |

*Primary Examiner* — Mark T Le
(74) *Attorney, Agent, or Firm* — American Patent Agency PC; Daniar Hussain; Stephen M. Hou

(57) ABSTRACT

The present invention provides a system for automatic operation of a top hatch cover for a container, comprising a hatch cover, a cylinder mount, a main operating lever, a connecting link, and a hatch locking lever. The cylinder mount is configured for pivotally connecting a piston to the container. A lower portion of the main operating lever is connected to a cylinder rod of an air cylinder. A first extension of the connecting link is rotatably connected to an upper portion of the main operating lever and a second extension of the connecting link is coupled to the hatch cover. The main operating lever and the hatch locking lever are rotatably coupled to a main shaft mount, where the hatch locking lever is configured to pivot around the main shaft mount to move between a locked position and an unlocked position.

20 Claims, 12 Drawing Sheets

(56) References Cited

U.S. PATENT DOCUMENTS

2005/0248177 A1* 11/2005 Obendiek ..... B60J 7/205
296/76
2007/0089638 A1 4/2007 Taylor

* cited by examiner

AUTOMATIC HATCH COVER FOR A CONTAINER AND METHODS OF OPERATION THEREOF

FIELD OF THE INVENTION

Embodiments of the present invention are in the field of manufacturing technology for railroad freight cars, and in particular, relate to automatic top hatch covers for containers.

BACKGROUND OF THE INVENTION

The statements in the background of the invention are provided to assist with understanding the invention and its applications and uses, and may not constitute prior art.

A hopper car is a type of railroad freight car used to haul bulk commodities, such as coal, fertilizers, grains, iron ore, and the like. A hopper car may be covered or open on top, and may discharge its load through doors located on the underside of the car body. Loads are usually added to the hopper car through the top. A covered hopper car may have a cover on top, to protect the load from weather conditions, such as rain, snow, and the like. The cover on top may be actuated manually by an operator.

The hatch covers that are currently in the market are heavy and difficult to open. The process of opening and closing of these hatch covers is time-consuming and exposes the operator to potential injuries.

There is a need for a system that can replace these existing traditional methods and make the operation of opening and closing of the hatch covers easier and less time consuming and without any potential injuries to the operator.

It is against this background that the present invention was developed.

BRIEF SUMMARY OF THE INVENTION

This summary is provided to help understand aspects of the invention, but is not intended to limit the scope of the invention or its application or uses.

In one embodiment, the present invention provides a system for automatic operation of a top hatch cover (230) for a container (200) or a hopper car (102). The top hatch cover operating mechanism comprises the hatch cover (230), a cylinder mount (206), a main operating lever (212), a connecting link (218), and a hatch locking lever (222). The cylinder mount (206) is coupled to a body (204) of the container (200), where the cylinder mount (206) is configured for pivotally connecting a piston to the body (204) of the container (200). The piston comprises an air cylinder (208) and a cylinder rod (210). The main operating lever (212) has a lower portion (212*a*) and an upper portion (212*b*), where the lower portion (212*a*) of the main operating lever (212) is connected to the cylinder rod (210) of the air cylinder (208). The main operating lever (212) is rotatably coupled to a main shaft mount (216). The connecting link (218) has a first extension (218*b*) and a second extension (218*a*), where the first extension (218*b*) is rotatably connected to the upper portion (212*b*) of the main operating lever (212), and the second extension (218*a*) is coupled to the hatch cover (230). The hatch locking lever (222) is rotatably coupled to the main shaft mount (216). The hatch locking lever (222) is configured to pivot around the main shaft mount (216) to move between a first position and a second position, in response to rotation of the main operating lever (212) along the main shaft mount (216), where the rotation of the main operating lever (212) is in response to the movement of the cylinder rod (210) from a first position to a second position. Further, the second extension (218*a*) of the connecting link (218) is enabled to open the hatch cover (230) on top (202) of the container (200), in response to the rotation of the first extension (218*b*) of the connecting link (218) connected to the upper portion (212*b*) of the main operating lever (212).

In another embodiment, the main operating lever (212) is a Z-shaped attachment.

In yet another embodiment, the first extension (218*b*) of the connecting link (218) is rotatably connected to the upper portion (212*b*) of the main operating lever (212) with a second pin (220*b*), and the second extension (218*a*) of the connecting link (218) is coupled to the hatch cover (230) with a hatch cover fulcrum (226), where the hatch cover fulcrum (226) is coupled to the hatch cover (230) with a hatch cover connector (228).

In yet another embodiment, the hatch cover connector (228) pivots about the hatch cover fulcrum (226) for opening the hatch cover (230).

In yet another embodiment, the connecting link (218) is an arch-shaped connecting link, where the arch-shaped connecting link (218) is accommodated over the main shaft mount (216) when the hatch locking lever (222) is in a locked position.

In yet another embodiment, the hatch cover operating mechanism comprises a hatch cover hinge (232) that fixes the hatch cover (230) to the body (204) of the container (200).

In yet another embodiment, a hatch locking pin (224) is attached to the hatch cover (230).

In yet another embodiment, the first position of the hatch locking lever (222) is a locked position, and the second position of the hatch locking lever (222) is an unlocked position. In the locked position, the hatch locking lever (222) is hooked on to the hatch locking pin (224) for securing the hatch cover (230) to the top (202) of the container (200). In the unlocked position, the hatch locking lever (222) is rotated away from the hatch locking pin (224) for the lifting of the hatch cover (230) from the top (202) of the container (200).

Other aspects and embodiments of the present invention will become apparent from the detailed description of the invention when read in conjunction with the attached drawings.

BRIEF DESCRIPTION OF THE DRAWINGS

Embodiments of the present invention described herein are exemplary, and not restrictive. Embodiments will now be described, by way of examples, with reference to the accompanying drawings. In these drawings, each identical or nearly identical component that is illustrated in various figures is represented by a like reference character. For purposes of clarity, not every component is labeled in every drawing. The drawings are not necessarily drawn to scale, with emphasis instead being placed on illustrating various aspects of the techniques and devices described herein.

DETAILED DESCRIPTION OF THE INVENTION

In the following description, for purposes of explanation, numerous specific details are set forth in order to provide a thorough understanding of the invention. It will be apparent, however, to one skilled in the art that the invention can be practiced without these specific details. In other instances, structures, devices, activities, and methods are shown using schematics, use cases, and/or flow diagrams in order to avoid obscuring the invention. Although the following description contains many specifics for the purposes of illustration, anyone skilled in the art will appreciate that many variations and/or alterations to suggested details are within the scope of the present invention. Similarly, although many of the features of the present invention are described in terms of each other, or in conjunction with each other, one skilled in the art will appreciate that many of these features can be provided independently of other features.

Embodiments of the present invention relate to a top hatch cover operating mechanism. The top hatch cover operating mechanism is configured for opening and closing a hatch cover on a top of a container or a hopper car. In one embodiment, the present invention provides a system for an automatic operation of the top hatch cover for the container or the hopper car.

Figure 1:
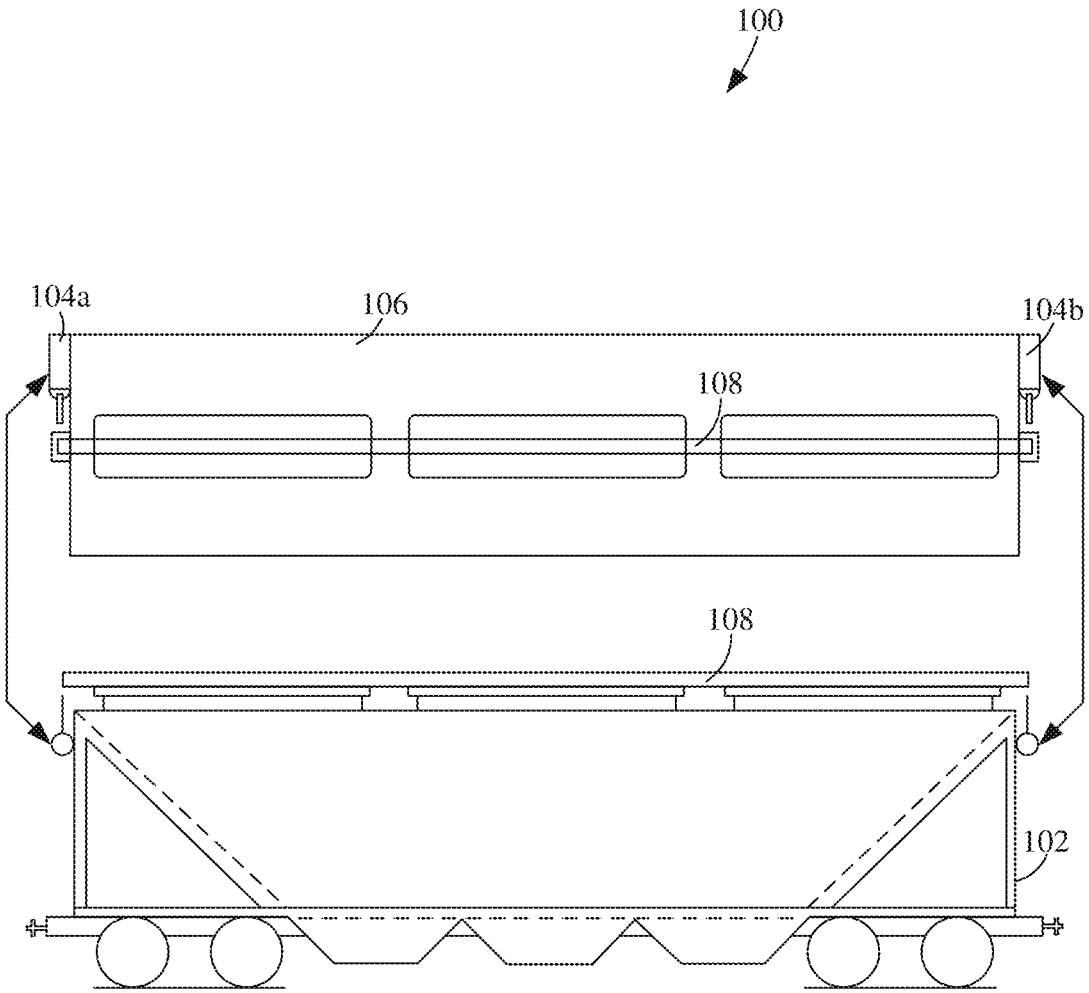
FIG. 1 shows a perspective view of a top and front side of the hatch cover enabled to couple with the hopper car, in accordance with an exemplary embodiment of the present invention.

FIG. 1 shows a perspective view of a top and front side (100) of the hatch cover (106) coupled to the hopper car (102), in accordance with an exemplary embodiment of the present invention. The hopper car (102) comprises a first mechanism cylinder (104*a*) and a second mechanism cylinder (104*b*) to drive the automatic operation of the hatch cover (106) as described herein. The hatch cover (106) is enabled to couple with the hopper car (102) with a hatch cover connector (108).

Figure 2:
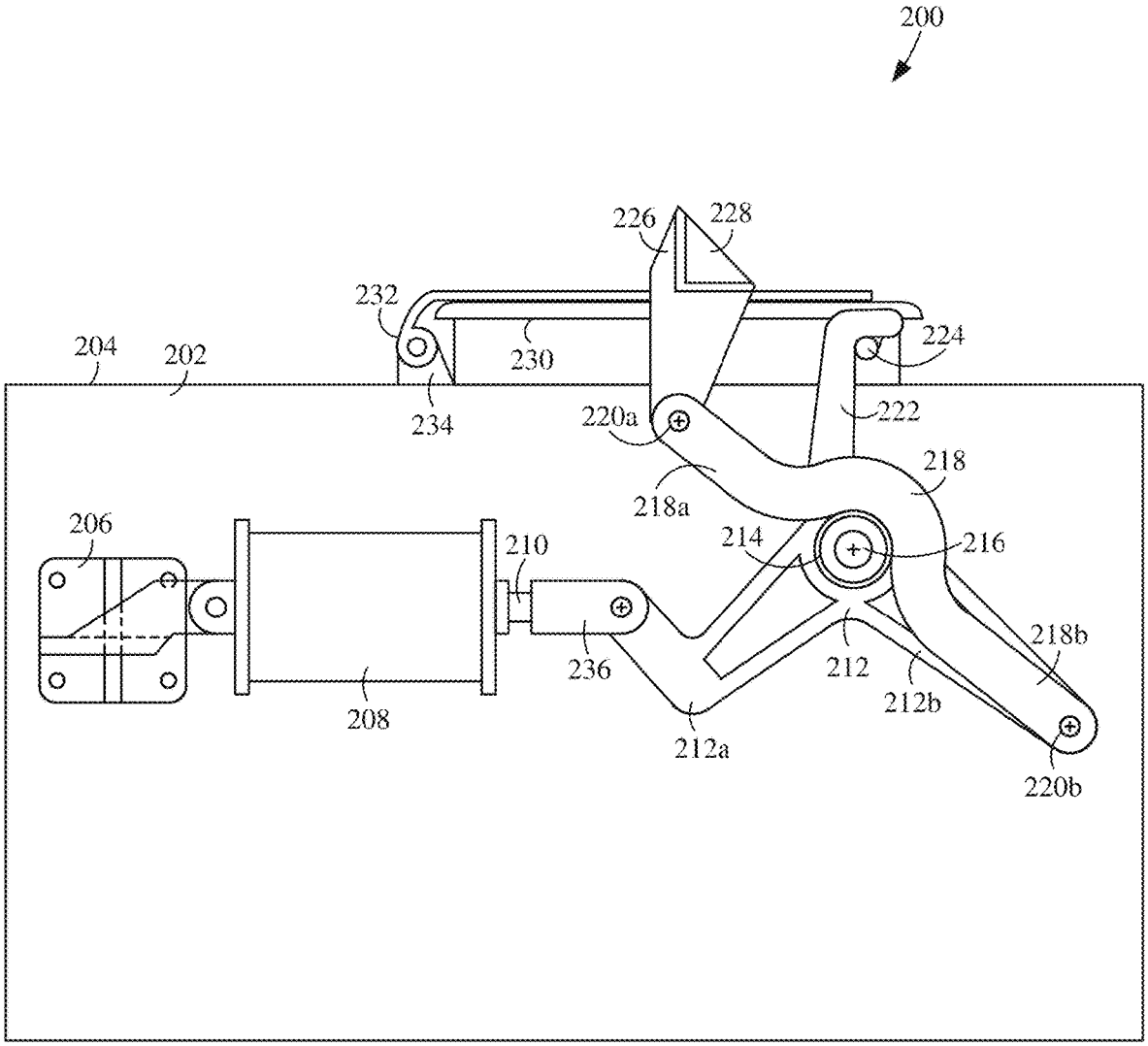
FIG. 2 shows a cross sectional view of the top hatch cover operating mechanism for automatically opening and closing the hatch cover on top of the container, in accordance with an exemplary embodiment of the present invention.

FIG. 2 shows a cross-sectional view of the top hatch cover operating mechanism for automatically opening and closing the hatch cover (230) on top (202) of the container (200), in accordance with an exemplary embodiment of the present invention. In the cross-sectional view, the hatch cover (230) is shown in a closed and locked position. The hatch cover operating mechanism comprising a cylinder mount (206), a piston, a main operating lever (212), a connecting link (218), a main shaft mount (216), and a hatch locking lever (222). The cylinder mount (206) is coupled to a body (204) of the container (200), wherein the cylinder mount (206) is configured for pivotally connecting the piston to the body (204) of the container (200). The piston comprises an air cylinder (208), a cylinder rod (210), and a cylinder rod clevis (236), wherein the piston is configured to drive the top hatch cover operating mechanism. The cylinder mount (206) is configured to connect the piston to the body (204) of the container (200) via a third pin (220*c*) that enables the air cylinder (208) to pivot. The main operating lever (212) has a lower portion (212*a*) and an upper portion (212*b*), wherein the lower portion (212*a*) of the main operating lever (212) is connected to the cylinder rod (210) of the air cylinder (208) via the cylinder rod clevis (236). Further, the main operating lever (212) is rotatably coupled to the main shaft mount (216). The connecting link (218) has a first extension (218*b*) and a second extension (218*a*), wherein the first extension (218*b*) is rotatably connected to the upper portion (212*b*) of the main operating lever (212) via a second pin (220*b*). The second extension (218*a*) of the connecting link (218) is coupled to the hatch cover (230) with a hatch cover fulcrum (226), wherein the hatch cover fulcrum (226) is coupled to the hatch cover (230) with a hatch cover connector (228). The second extension (218*a*) of the connecting link (218) is attached to the hatch cover fulcrum (226) via a first pin (220*a*). The hatch locking lever (222) is rotatably coupled to the main shaft mount (216). The hatch locking lever (222) is configured to pivot around the main shaft mount (216) to move between a locked position and an unlocked position. The main shaft mount (216) is held by a rotatable grooved plate (214) that provides a resting position for the connecting link (218) when the hatch cover (230) is in a closed and locked position. Further, the hatch cover (230) comprises a hatch locking pin (224). The hatch locking lever (222) hooks onto the hatch locking pin (224) when the hatch cover (230) is closed and in the locked position. A hatch cover hinge (232) is enabled to couple the hatch cover (230) to the body (204) of the container (200).

Figure 3:
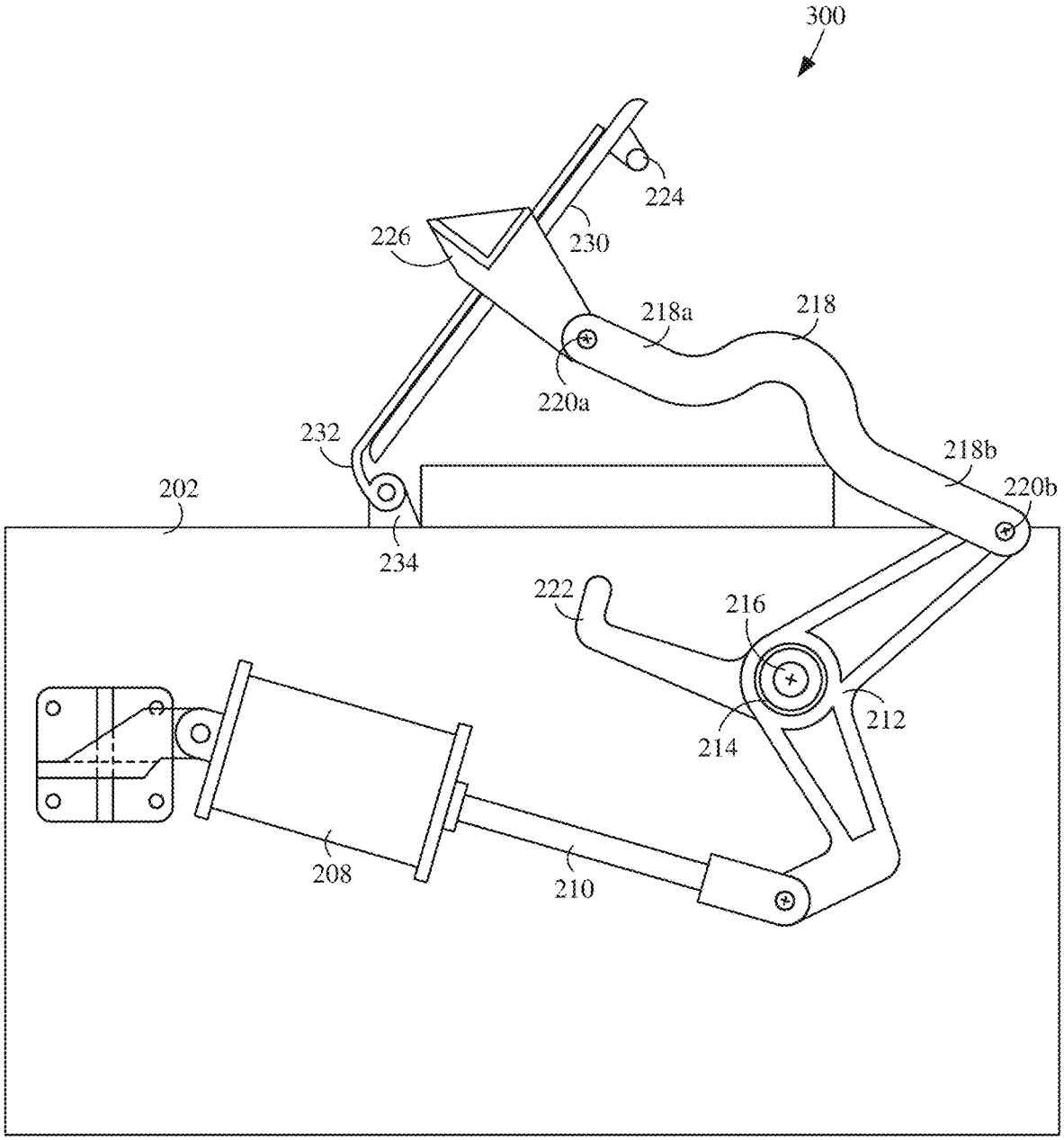
FIG. 3 shows a cross sectional view of the hatch cover being partially opened by the piston, in accordance with an exemplary embodiment of the present invention.

FIG. 3 shows a cross-sectional view (300) of the hatch cover (230) being partially opened by the piston, in accordance with an exemplary embodiment of the present invention. The cylinder rod (210) moves towards a second position from a first position, in response to air applied to the air cylinder (208), enabling the hatch locking lever (222) to move towards a second position from a first position to rotate away from the hatch locking pin (224). The hatch locking lever (222) pivots around the main shaft mount (216) to rotate away from the hatch locking pin (224), thereby unlocking the hatch cover (230). Further, continued movement of the cylinder rod (210) towards the second position actuates the main operating lever (212) to rotate around the main shaft mount (216), enabling the movement of the first extension (218*b*) of the connecting link (218) to release the connecting link (218) from the resting position on the grooved plate (214), thereby enabling the movement of the hatch cover fulcrum (226) by the second extension (218*a*) of the connecting link (218). The movement of the hatch cover fulcrum (226) enables the lifting of the hatch cover (230) from the top (202) of the container which enables the partial opening of the hatch cover (230). The hatch cover (230) is coupled to the top (202) of the container with a hatch cover hinge (232), enabling the lifting of the hatch cover (230) by the hatch cover fulcrum (226). The hatch cover fulcrum (226) is connected to the second extension (218*a*) of the connecting link (218) via the first pin (220*a*).

In an embodiment, the connecting link (218) rotates in response to the rotation of the main operating lever (212) around the main shaft mount (216) for lifting the hatch cover fulcrum (226) to open the hatch cover (230). The hatch cover hinge (232) pivots around a hinge fulcrum (234) for opening or closing the hatch cover (230).

Figure 4:
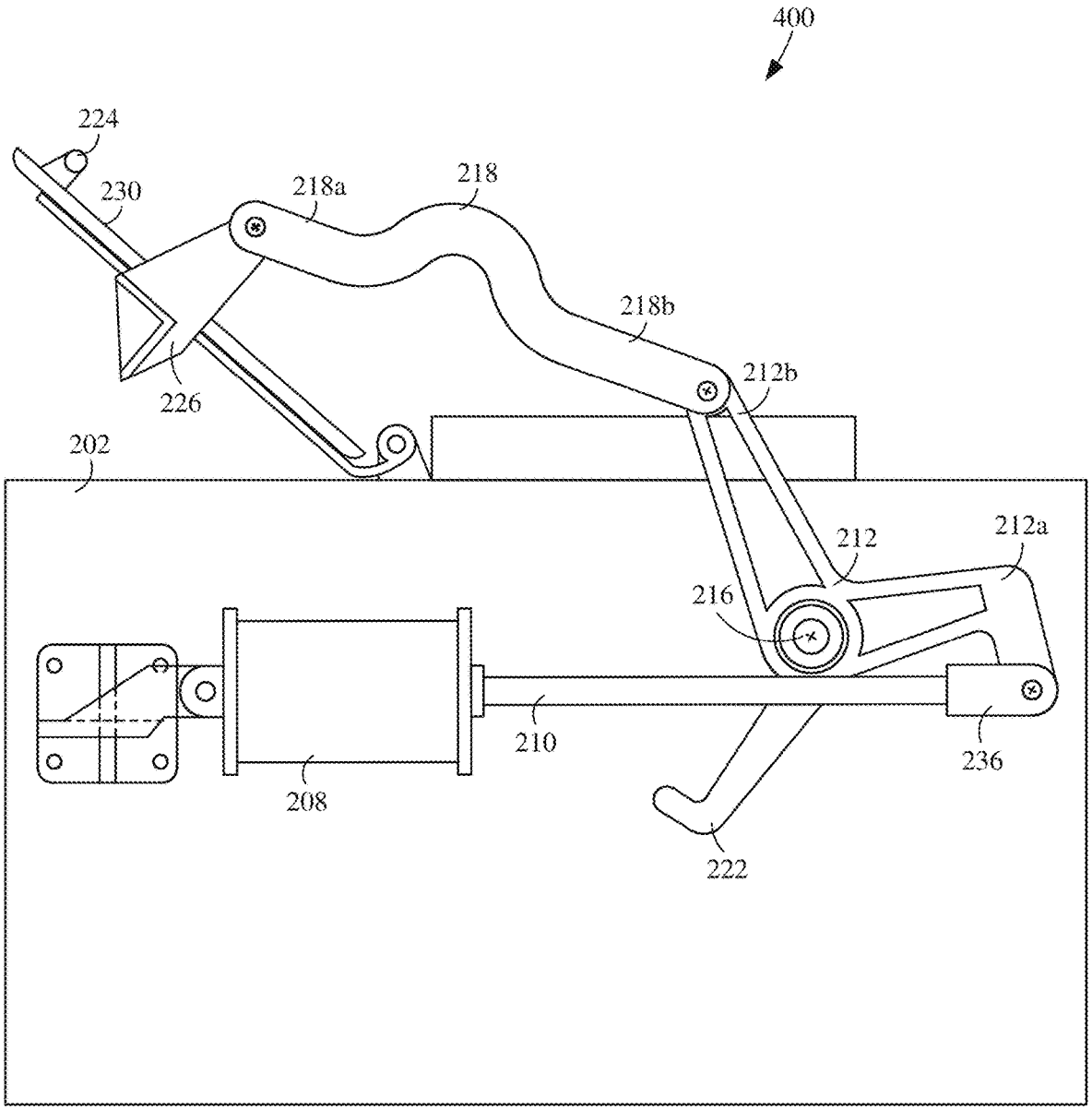
FIG. 4 shows another cross-sectional view of the unlocked hatch cover in a fully open position, in accordance with an exemplary embodiment of the present invention.

FIG. 4 shows another cross-sectional view (400) of the unlocked hatch cover (230) in a fully open position, in accordance with an exemplary embodiment of the present invention. The cylinder rod (210) of the air cylinder (208) is at the second position. The hatch locking lever (222) is at the second position, in response to rotation of the main operating lever (212) along the main shaft mount (216), wherein the rotation of the main operating lever (212) is in response to the movement of the cylinder rod (210) towards the second position. Further, the second extension (218*a*) of the connecting link (218) open the hatch cover (230) on top (202) of the container with the hatch cover fulcrum (226) to a fully open position, in response to the rotation of the first extension (218*b*) of the connecting link (218) connected to the upper portion (212*b*) of the main operating lever (212), when the cylinder rod (210) reaches the second position.

Figure 5:
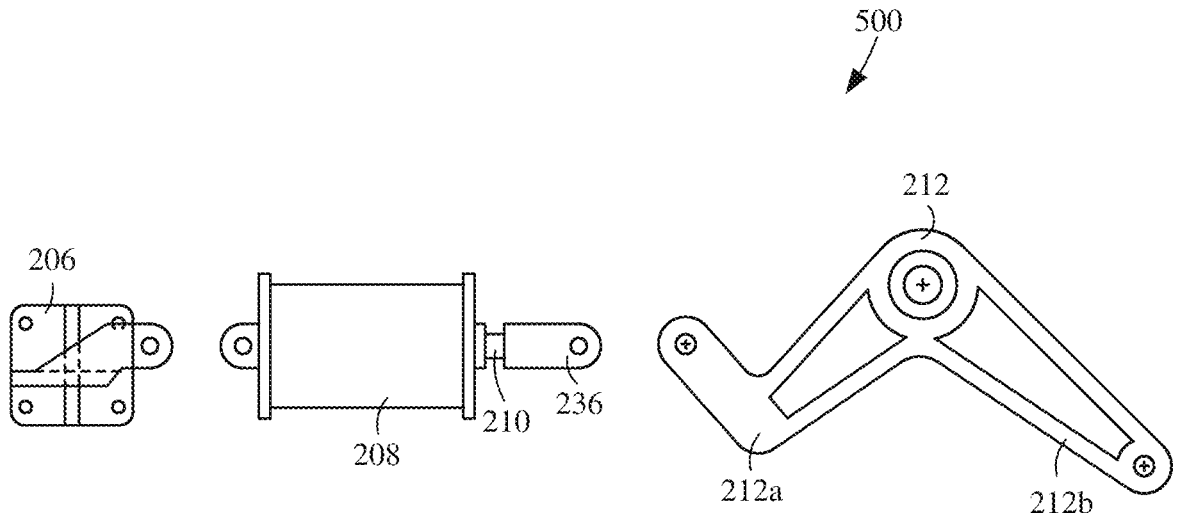
FIG. 5 shows a diagram showing disparate pieces of the piston, in accordance with an exemplary embodiment of the present invention.

FIG. 5 shows a diagram (500) showing disparate pieces of the piston, in accordance with an exemplary embodiment of the present invention. The piston comprises the air cylinder (208), the cylinder rod (210), and the cylinder rod clevis (236). The cylinder mount (206) is coupled to the body of the container, wherein in one embodiment, the container is a hopper car. The cylinder mount (206) is configured for pivotally connecting the air cylinder (208) to the body of the hopper car. The cylinder rod (210) moves in a forward direction when air is applied to the air cylinder (208) and moves backward when air is released from the air cylinder (208). The cylinder rod clevis (236) is connected to the air cylinder (208) with the cylinder rod (210). The main operating lever (212) has the lower portion (212*a*) and the upper portion (212*b*). Further, the lower portion (212*a*) of the main operating lever (212) is connected to the air cylinder (208) with the cylinder rod clevis (236). In one example, the main operating lever (212) is a Z or N shaped attachment.

Figure 6:
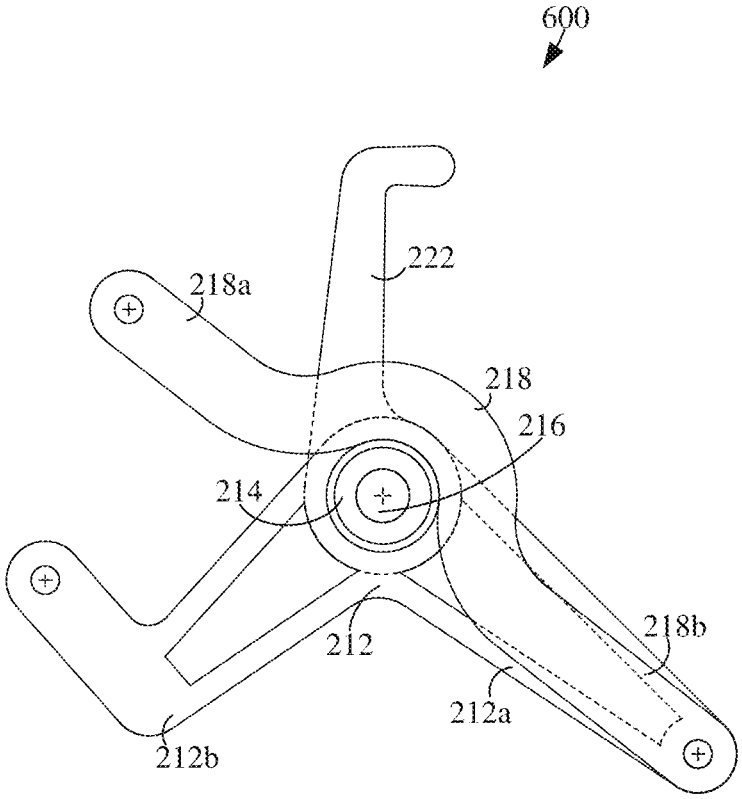
FIG. 6 shows a close-up view of the main operating lever, the connecting link, the main shaft mount, and the hatch locking lever, in accordance with an exemplary embodiment of the present invention.

FIG. 6 shows a close-up view (600) of the main operating lever (212), the connecting link (218), the main shaft mount (216), and the hatch locking lever (222), in accordance with an exemplary embodiment of the present invention. The main shaft mount (216) is coupled to the body of the container such as a hopper car. The main shaft mount (216) is held by the rotatable grooved plate (214). The connecting link (218) has the first extension (218*b*) and the second extension (218*a*), wherein the connecting link (218) is an arch-shaped link and is enabled to accommodate over the rotatable grooved plate (214) of the main shaft mount (216) when the hatch locking lever (222) is in the locked position. The main operating lever (212) and the hatch locking lever (222) is rotatably coupled to the main shaft mount (216). The main operating lever (212) has the lower portion (212*a*), and the upper portion (212*b*). The main operating lever (212) is movably coupled to the main shaft mount (216). In an embodiment, the lower portion (212*a*) of the main operating lever (212) is shorter in length than the upper portion (212*b*) of the main operating lever (212). The lower portion (212*a*) of the main operating lever (212) is connected to the cylinder rod with the cylinder rod clevis, and the upper portion (212*b*) is rotatably coupled to the first extension (218*b*) of the connecting link (218).

Figure 7:
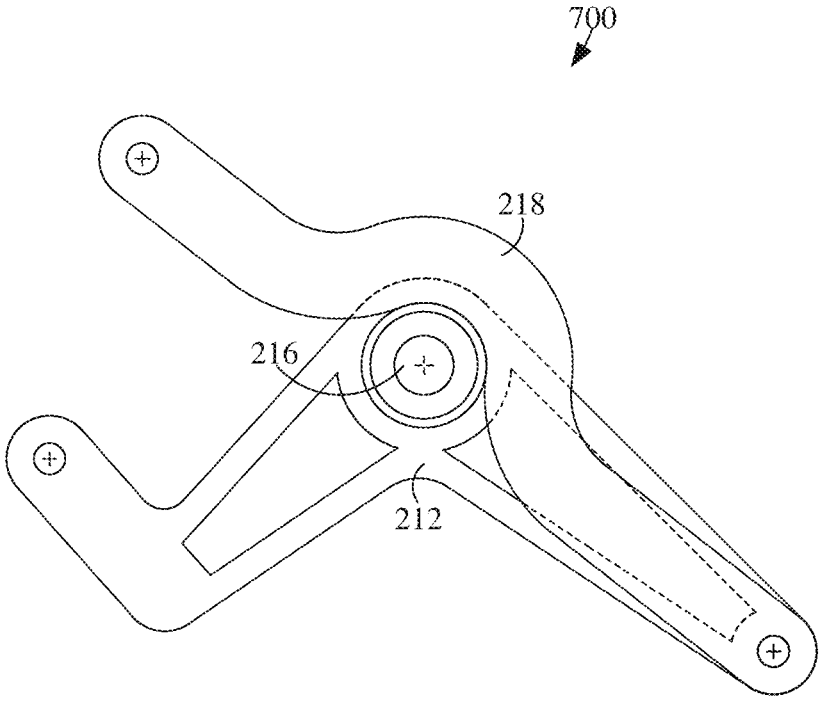
FIG. 7 shows another cross-sectional view of the connecting link and the main operating lever, in accordance with an exemplary embodiment of the present invention.

FIG. 7 shows another cross-sectional view (700) of the connecting link (218) and the main operating lever (212), in accordance with an exemplary embodiment of the present invention. The connecting link (218) is configured to connect the main shaft mount (216) with the hatch cover of the hopper car. A portion of the main operating lever (212) is coupled to the main shaft mount (216). In an embodiment, the portion is a middle portion of the main operating lever (212).

Figure 8:
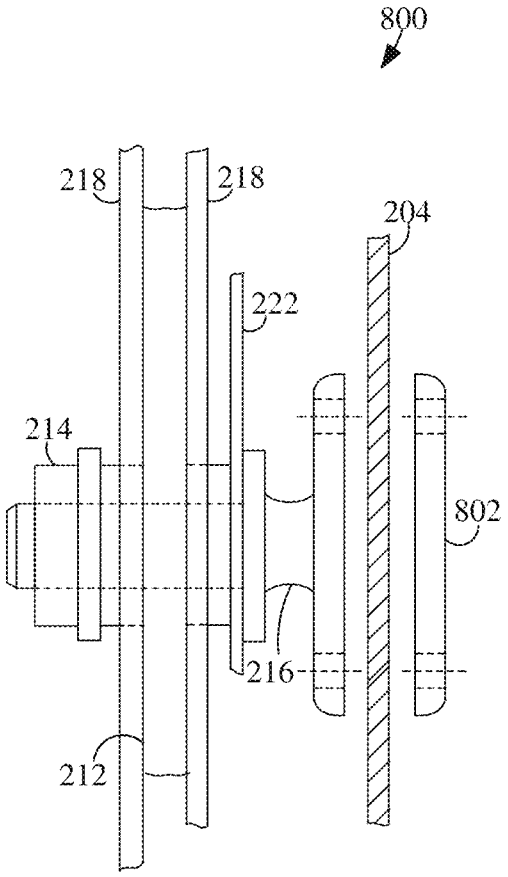
FIG. 8 shows a sidewise cross-sectional view of the hatch cover operating mechanism, in accordance with an exemplary embodiment of the present invention.

FIG. 8 shows a sidewise cross-sectional view (800) of the hatch cover operating mechanism, in accordance with an exemplary embodiment of the present invention. The main shaft mount (216) is held by the rotatable grooved plate (214), and the main shaft mount (216) is enabled to hold the main operating lever (212). The main shaft mount (216) is coupled to the container body (204) via a mounting plate (802). The hatch locking lever (222) is coupled to the main shaft mount (216) and the connecting link (218) accommodates over the rotatable grooved plate (214) when the hatch locking lever (222) is in the locked position.

Figure 9:
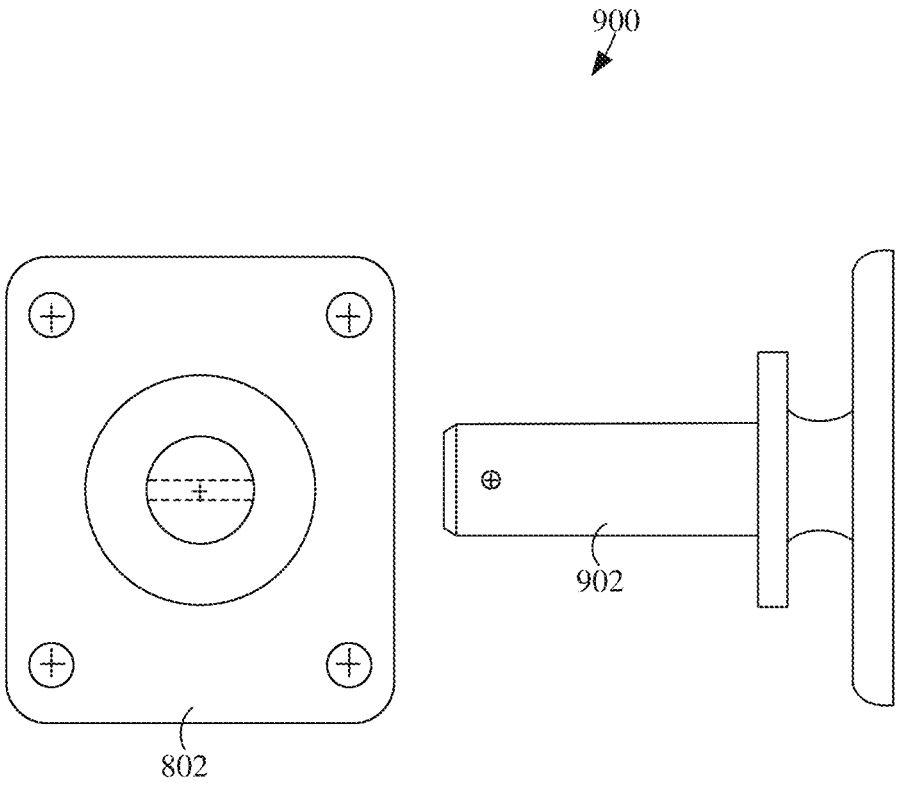
FIG. 9 shows a sidewise cross-sectional view of the main shaft mount, in accordance with an exemplary embodiment of the present invention.

FIG. 9 shows a sidewise cross-sectional view (900) of the main shaft mount, in accordance with an exemplary embodiment of the present invention. The main shaft mount comprises the mounting plate (802), and a screw (902) that is fixed to the mounting plate (802).

Figure 10:
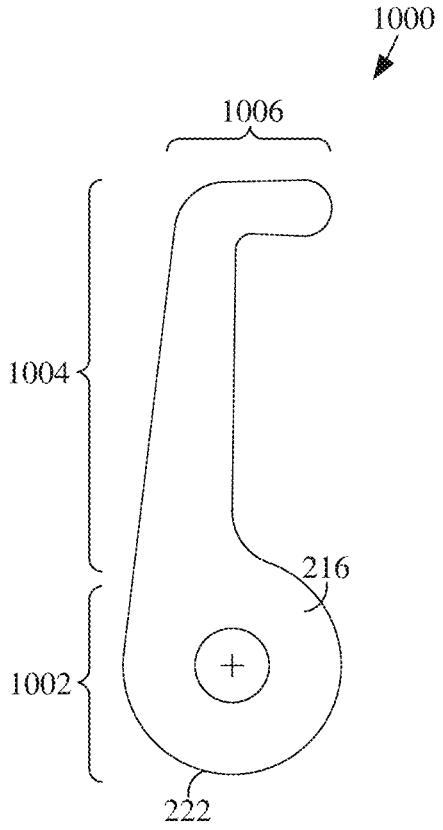
FIG. 10 shows a perspective view of the hatch locking lever, in accordance with an exemplary embodiment of the present invention.

FIG. 10 shows a perspective view (1000) of the hatch locking lever (222), in accordance with an exemplary embodiment of the present invention. The hatch locking lever (222) has a circular base (1002), an inverted L-shaped extension (1004) that protrudes from the circular base (1002), and a hook (1006). The circular base (1002) has a hole (1008) at the center to receive the main shaft mount. The hatch locking lever (222) is pivotally coupled to the main shaft mount. The hook (1006) of the hatch locking lever (222) is shaped in order to latch on to the hatch locking pin of the hatch cover.

Figure 11:
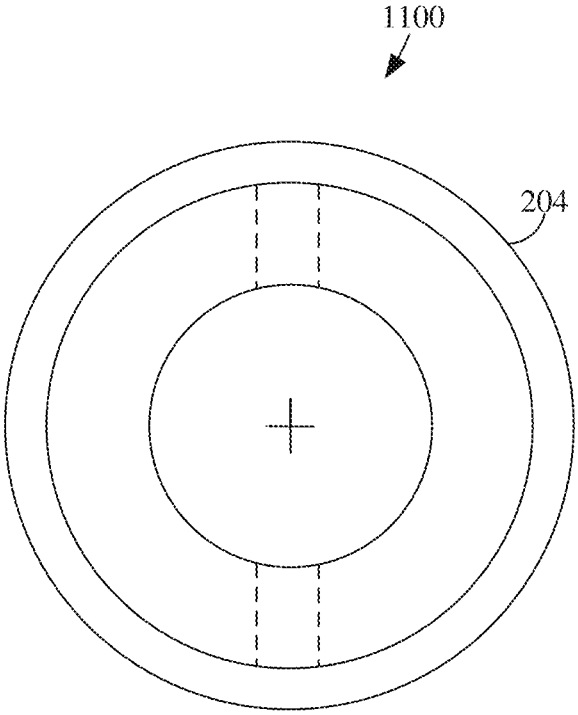
FIG. 11 shows a front view of the rotatable grooved plate, in accordance with an exemplary embodiment of the present invention.

FIG. 11 shows a front view (1100) of the rotatable grooved plate (214), in accordance with an exemplary embodiment of the present invention.

Figure 12:
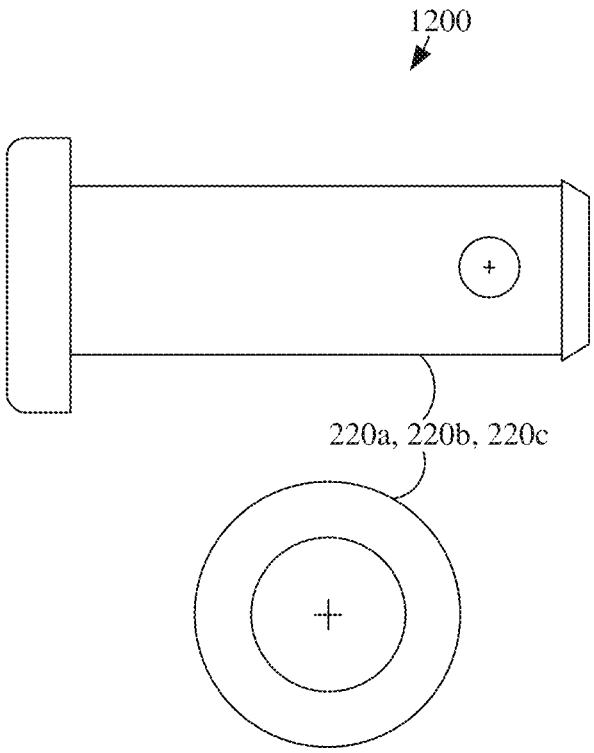
FIG. 12 shows a front and side view of the first pin, the second pin, and the third pin, in accordance with an exemplary embodiment of the present invention.

FIG. 12 shows a front and side view (1200) of the first pin, the second pin, and the third pin (220*a*, 220*b*, 220*c*), in accordance with an exemplary embodiment of the present invention.

In accordance with a preferred embodiment of the present invention, the hatch locking lever (222) of the automatic hatch cover operating mechanism moves from the first position to the second position, in response to rotation of the main operating lever (212) along with the main shaft mount (216), wherein the rotation of the main operating lever (212) is in response to the movement of the cylinder rod (210) from the first position to the second position when the air is applied to the air cylinder (208). The second extension (218*a*) of the connecting link (218) is enabled to open the hatch cover (230) on top (202) of the container (200), in response to the rotation of the first extension (218*b*) of the connecting link (218) connected to the upper portion (212*b*) of the main operating lever (212). The first position of the hatch locking lever (222) is the locked position, and the second position of the hatch locking lever (222) is the unlocked position. In the locked position, the hatch locking lever (222) is firmly hooked on to the hatch locking pin (224) for securing the hatch cover (230) to the top (202) of the container (200). In the unlocked position, the hatch locking lever (222) is rotated away from the hatch locking pin (224) for opening the hatch cover (230) on top (202) of the container (200).

In an exemplary embodiment, the hatch locking lever (222) of the automatic hatch cover operating mechanism moves from the second position to the first position, in response to rotation of the main operating lever (212) along with the main shaft mount (216), wherein the rotation of the main operating lever (212) is in response to the movement of the cylinder rod (210) from the second position to the first position when the air is released from the air cylinder (208). Further, the second extension (218*a*) of the connecting link (218) closes the top hatch cover (230) of the container (200), in response to the rotation of the first extension (218*b*) of the connecting link (218) connected to the upper portion (212*b*) of the main operating lever (212).

In one exemplary embodiment, the cylinder rod (210) extends forward, when moving from the first position to the second position, and the cylinder rod (210) moves backward when moving from the second position to the first position.

In another embodiment, the main operating lever (212) is Z or N shaped attachment.

In yet another embodiment, the first extension (218*b*) of the connecting link (218) is rotatably connected to the upper portion (212*b*) of the main operating lever (212) via the second pin (220*b*), and the second extension (218*a*) of the connecting link (218) is coupled to the hatch cover (230) with the hatch cover fulcrum (226), wherein the hatch cover fulcrum (226) is coupled to the hatch cover (230) with the hatch cover connector (228).

In yet another embodiment, the hatch cover connector (228) pivots about the hatch cover fulcrum (226) for opening or closing the hatch cover (230).

In yet another embodiment, the connecting link (218) is arch-shaped connecting link, wherein the arch-shaped connecting link (218) is accommodated over the main shaft mount (216) when the hatch locking lever (222) is in the locked position.

In yet another embodiment, the hatch cover operating mechanism comprises the hatch cover hinge (232) that fixes the hatch cover (230) to the body (204) of the container (200).

In yet another embodiment, the hatch locking pin (224) is attached to the hatch cover (230).

In yet another embodiment, the first position of the hatch locking lever (222) is the locked position, and the second position of the hatch locking lever (222) is the unlocked position. In the locked position, the hatch locking lever (222) is hooked on to the hatch locking pin (224) for securing the hatch cover (230) to the top (202) of the container (200). In the unlocked position, the hatch locking lever (222) is rotated away from the hatch locking pin (224) for the opening of the hatch cover (230) on top (202) of the container (200).

One of ordinary skill in the art knows that the use cases, structures, schematics, and flow diagrams may be performed in other orders or combinations, but the inventive concept of the present invention remains without departing from the broader scope of the invention. Every embodiment may be unique, and methods/steps may be either shortened or lengthened, overlapped with the other activities, postponed, delayed, and continued after a time gap, to accommodate to the practice of the methods of the present invention.

Although the present invention has been described with reference to specific exemplary embodiments, it will be evident that the various modification and changes can be made to these embodiments without departing from the broader scope of the invention. Accordingly, the specification and drawings are to be regarded in an illustrative sense rather than in a restrictive sense. It will also be apparent to the skilled artisan that the embodiments described above are specific examples of a single broader invention which may have greater scope than any of the singular descriptions taught. There may be many alterations made in the descriptions without departing from the scope of the present invention.

What is claimed is:

1. An automatic hatch cover operating mechanism configured for opening a hatch cover on a top of a container, comprising:

a cylinder mount coupled to a body of the container, configured for pivotally connecting a piston to the body of the container, wherein the piston comprises a cylinder rod;

a main operating lever having a lower portion and an upper portion, wherein the lower portion of the main operating lever is connected to the cylinder rod, wherein the main operating lever is rotatably coupled to a main shaft mount;

a connecting link having a first extension and a second extension, wherein the first extension is rotatably connected to the upper portion of the main operating lever and the second extension is coupled to the hatch cover with a hatch cover fulcrum; and a hatch locking lever, rotatably coupled to the main shaft mount, configured to pivot around the main shaft mount, enabled to move between a first position and a second position, wherein the hatch locking lever moves from the first position to the second position in response to rotation of the main operating lever along the main shaft mount, wherein the rotation of the main operating lever is in response to movement of the cylinder rod, and wherein the second extension of the connecting link is enabled to open the hatch cover on top of the container, in response to the rotation of the first extension connected to the upper portion of the main operating lever.

2. The automatic hatch cover operating mechanism of claim 1, wherein the main operating lever is a Z-shaped attachment.

3. The automatic hatch cover operating mechanism of claim 1, wherein the hatch cover fulcrum is coupled to the hatch cover with a hatch cover connector.

4. The automatic hatch cover operating mechanism of claim 3, wherein the hatch cover connector pivots about the hatch cover fulcrum for opening the hatch cover.

5. The automatic hatch cover operating mechanism of claim 1, wherein the first extension of the connecting link is rotatably connected to the upper portion of the main operating lever via a second pin.

6. The automatic hatch cover operating mechanism of claim 1, wherein the connecting link is an arch-shaped connecting link.

7. The automatic hatch cover operating mechanism of claim 6, wherein the arch-shaped connecting link is accommodated over the main shaft mount when the hatch locking lever is in a locked position.

8. The automatic hatch cover operating mechanism of claim 1, further comprising:

a hatch cover hinge that fixes the hatch cover to the body of the container.

9. The automatic hatch cover operating mechanism of claim 1, wherein the main shaft mount is coupled to the body of the container.

10. The automatic hatch cover operating mechanism of claim 1, further comprising:

a hatch locking pin attached to the hatch cover.

11. The automatic hatch cover operating mechanism of claim 10, wherein the first position is a locked position, and the second position is an unlocked position.

12. The automatic hatch cover operating mechanism of claim 11, wherein in the locked position, the hatch locking lever is firmly hooked on to the hatch locking pin for securing the hatch cover to the top of the container, and wherein in the unlocked position, the hatch locking lever is rotated away from the hatch locking pin for the opening of the hatch cover on top of the container.

13. A hopper car, comprising:

a hatch cover that covers a top of the hopper car; and an automatic hatch cover operating mechanism, comprising:

a cylinder mount coupled to a body of the hopper car, configured for pivotally connecting a piston to the body of the hopper car, wherein the piston comprises a cylinder rod;

a main operating lever having a lower portion and an upper portion, wherein the lower portion of the main operating lever is connected to the cylinder rod, wherein the main operating lever is rotatably coupled to a main shaft mount;

a connecting link having a first extension and a second extension, wherein the first extension is rotatably connected to the upper portion of the main operating lever and the second extension is coupled to the hatch cover with a hatch cover fulcrum; and a hatch locking lever, rotatably coupled to the main shaft mount, configured to pivot around the main shaft mount, enabled to move between a first position and a second position, wherein the hatch locking lever moves from the first position to the second position in response to rotation of the main operating lever along the main shaft mount, wherein the rotation of the main operating lever is in response to movement of the cylinder rod, and wherein the second extension of the connecting link is enabled to open the hatch cover on top of the hopper car, in response to the rotation of the first extension connected to the upper portion of the main operating lever.

14. The hopper car of claim 13, further comprising:

a hatch cover hinge configured to couple the hatch cover to the body of the hopper car.

15. The hopper car of claim 13, wherein the hatch cover fulcrum is coupled to the hatch cover with a hatch cover connector.

16. The hopper car of claim 15, wherein the hatch cover connector pivots about the hatch cover fulcrum for opening the hatch cover.

17. The hopper car of claim 13, further comprising:

a hatch locking pin coupled to the hatch cover.

18. The hopper car of claim 17, wherein the first position is a locked position, and the second position is an unlocked position.

19. The hopper car of claim 18, wherein in the locked position, the hatch locking lever is firmly hooked on to the hatch locking pin for securing the hatch cover to the top of the hopper car, and wherein in the unlocked position, the hatch locking lever is rotated away from the hatch locking pin for the lifting of the hatch cover on top of the hopper car.

20. The hopper car of claim 13, wherein the main operating lever is a Z-shaped attachment.

* * * * *